United States Patent [19]

Randall, Jr. et al.

[11] Patent Number: 4,880,168

[45] Date of Patent: Nov. 14, 1989

[54] APPARATUS FOR JETTING HIGH VELOCITY LIQUID STREAMS ONTO FIBROUS MATERIALS

[75] Inventors: Kenneth R. Randall, Jr., Gorham; Laurent R. Parent, Windham, both of Me.

[73] Assignee: Honeycomb Systems, Inc., Biddeford, Me.

[21] Appl. No.: 73,968

[22] Filed: Jul. 13, 1987

[51] Int. Cl.[4] ..... B05B 1/14

[52] U.S. Cl. ..... 239/553.5; 239/105; 239/553; 239/600

[58] Field of Search ..... 239/104, 105, 106, 162, 239/600, 553, 553.3, 553.5, 556

[56] References Cited

U.S. PATENT DOCUMENTS

| | | | |
|---|---|---|---|
| 3,403,862 | 10/1968 | Dworjanyn | 239/566 |
| 3,613,999 | 10/1971 | Bentley | 239/553.3 |
| 4,638,327 | 1/1987 | Sutera et al. | 239/553.5 |

*Primary Examiner*—Andres Kashnikow
*Assistant Examiner*—Christopher G. Trainor
*Attorney, Agent, or Firm*—Joseph W. Molasky & Assocs.

[57] ABSTRACT

An apparatus for jetting high velocity liquid streams onto fibrous materials is constructed to provide a uniform distribution of the liquid medium to a nozzle strip through which the liquid streams are directed onto the fibrous material. The apparatus is constructed so that the nozzle strip can be removed from the cartridge containing the same quickly and with a minimum of part removal.

14 Claims, 4 Drawing Sheets

APPARATUS FOR JETTING HIGH VELOCITY LIQUID STREAMS ONTO FIBROUS MATERIALS

BACKGROUND OF THE INVENTION

1. Field of the Invention

This invention relates to the field of jet entangling. The process of jet entangling, which is also called hydroentangling, hydraulic entangling, water jet needling, tanglelacing and spunlacing, is accomplished by forcing a liquid, usually water, at high pressures through nozzles or orifices to form fine columnar streams and directing a curtain of these streams or jets onto a fibrous web. The fibrous web to be treated is passed on a supporting screen through the curtain of water jets whereby the fibers are entangled to form a coherent textile web without the use of binders or resins. While the physical process of entanglement is not completely understood, it is believed that the turbulent breakup of the fine liquid streams as they impinge on and pass over the fibers in the web and the strands of the supporting screen causes physical intertwining of the fibers. The supporting screen can be of a suitable open area to impart its pattern on the entangled fabric giving a textile-like appearance, or the screen can be of sufficiently fine mesh to give a uniform, smooth appearance to the web.

The uniformity of product quality generated by the jet entangling process is directly affected by two variables, namely, (1) the quality of the supporting screen, and (2) the quality of the liquid jets. The present invention relates to the generation of high quality jets, which depends primarily on the uniform distribution of liquid to the nozzle strip and the precise filtering of the liquid medium.

2. Description of the Prior Art

U.S. Pat. Nos. 3,508,308 and 4,069,563 provide a general background description of the process of jet entangling.

U.S. Pat. No. 3,403,862 discloses a jet manifold for tanglelacing textile-like fabrics. The apparatus disclose in this patent includes a nozzle strip secured in place by a slotted retaining plate which is bolted to the manifold body. Liquid is delivered to the nozzle strip from a chamber which is fed through a series of drilled holes to a delivery tube.

U.S. Pat. No. 3,513,999 discloses an apparatus for jetting liquid onto a fibrous web which consists of an elongated body having a longitudinal chamber therein. A nozzle strip is enclosed within a cartridge device which can be inserted into the longitudinal chamber in the elongated body. The cartridge device has a slot in the bottom which aligns with a corresponding slot within the elongated body permitting the passage of liquid jets. The cartridge device has an open portion facing upwardly which has bolted thereto a filter through which pressurized liquid is supplied. Removal of the nozzle strip for cleaning is accomplished by first removing the cartridge device from the elongated body and then removing a series of bolts and the filter device.

The devices disclosed in U.S. Pat. Nos. 3,403,862 and 3,513,999 have several disadvantages. These disadvantages include (1) the incomplete and non-uniform distribution of liquid to the nozzle strips and (2) the lengthy disassembly time required for the removal of the nozzle strips for cleaning. Incomplete and ineffective liquid distribution to the orifices in the nozzle strip result in turbulence and improper entry of liquid into the nozzle orifices which results in noncircular and/or deflected jets yielding streaks in the textile-like web. The downtime required to clean the nozzle strips is directly related to the ease with which the strip can be removed from the device and hence the number of bolts which must be removed to gain access to the strip.

SUMMARY OF THE INVENTION

It is the general object of this invention to provide an improved apparatus for jetting high velocity liquid jets onto fibrous material. More specifically, the improvements are directed to (1) an improved distribution of the liquid medium to the nozzle strip and (2) a means by which the nozzle strip can be removed from a cartridge assembly without the time consuming removal of bolts and cover plates when it is desired to effect cleaning of said strip.

Briefly stated, the general objects of the invention are achieved by a construction comprising a manifold having a body defining an elongated internal manifold chamber and an elongated internal cartridge chamber, said body having a flow distribution means therein providing flow communication between the manifold chamber and an upper portion of the cartridge chamber. The manifold body also has a bottom wall portion having an elongated slot therein providing communication between the lower portion of the cartridge chamber and the exterior of the manifold body. The apparatus includes an elongated cartridge adapted to be received in the cartridge chamber in a position to be supported by the bottom wall portion of the manifold body and to overlie the slot therein, said cartridge having a body defining an elongated internal chamber and a bottom wall portion adjacent the bottom wall portion of the manifold body and having an elongated slot therein aligned with the slot in the bottom wall portion of the manifold body. The cartridge also has a top wall portion spaced apart above the bottom wall portion thereof and having a plurality of flow ports therein providing flow communication between the exterior of the cartridge and the internal chamber thereof. There is provided a nozzle strip adapted to be positioned adjacent the bottom wall of the cartridge and having a plurality of orifices therein aligned with the cartridge slot. The apparatus includes screen means positioned in the cartridge internal chamber to extend thereacross at at least one location spaced apart between the top and bottom wall portions of the cartridge. By this arrangement, high pressure liquid delivered to the manifold chamber flows through the flow distribution means to the upper portion of the cartridge from which the liquid flows sequentially through the flow ports in the top wall portion of the cartridge into the cartridge chamber, through the screen means, and through the nozzle strip orifices, the liquid being discharged from said nozzle strip orifices in a plurality of high velocity jets passing through the cartridge slot and the manifold body slot.

The manifold body is also provided with an access opening providing access to one end of the cartridge body and including a cover plate adapted to be removably received in the access opening and means for holding the cover plate in position to retain the cartridge within the manifold. The cartridge has an end cap located adjacent the access opening and having a clearance slot formed therein providing communication between the access opening and the internal chamber of the cartridge at a location aligned with the position of the nozzle strip. The nozzle strip is of a length such that an end portion thereof extends outwardly from the endcap so that it is accessable for removal of the nozzle strip from the cartridge while the cartridge remains within the manifold body.

DETAILED DESCRIPTION OF THE PREFERRED EMBODIMENT

Figure 1:
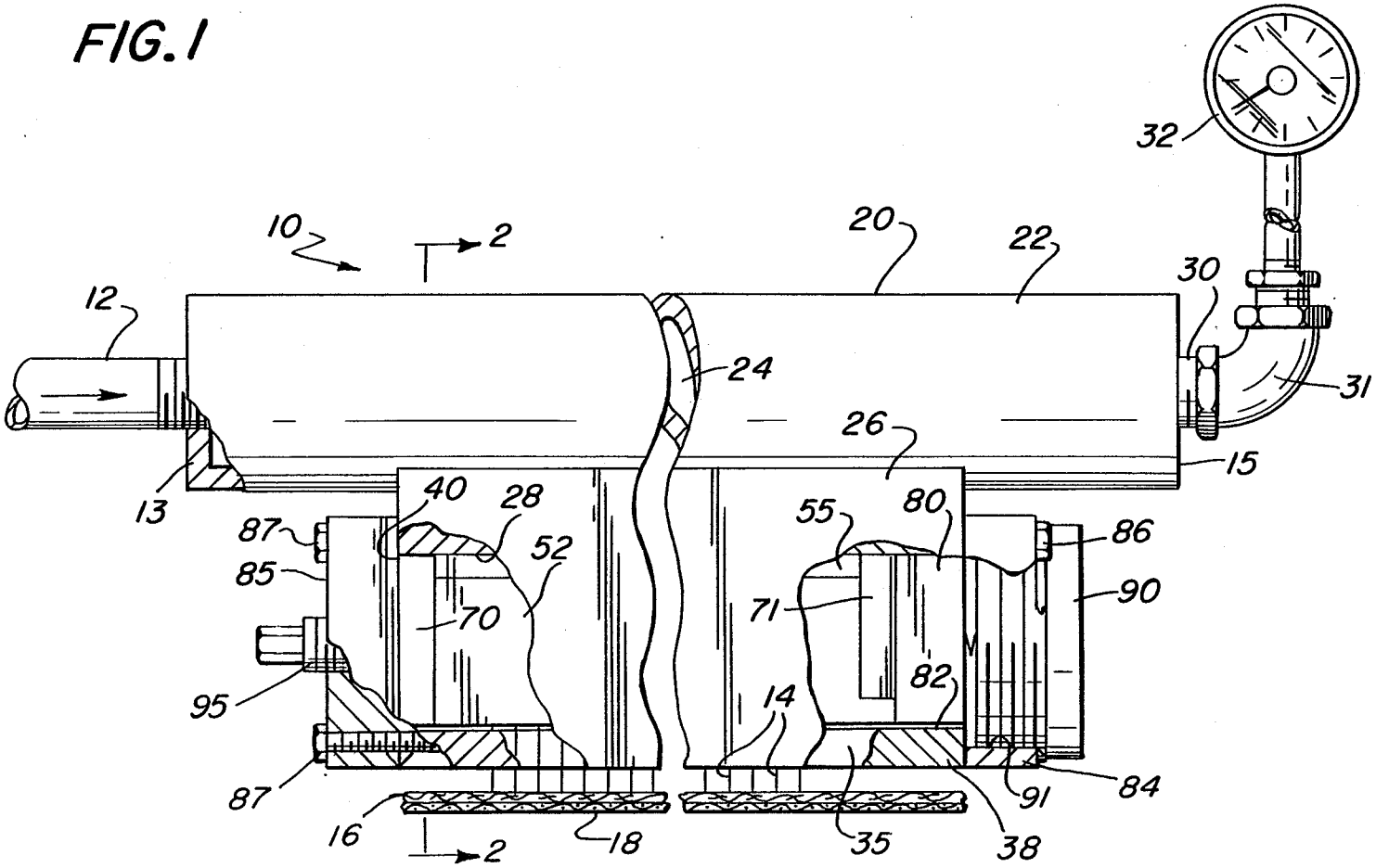
FIG. 1 is an elevation of the apparatus in accordance with the invention.

Referring to the Drawings in detail, there is shown in FIG. 1 an apparatus 10 in accordance with the invention for delivering high velocity liquid jets into a fibrous web for jet entanglement purposes. As shown in FIG. 1, the apparatus 10 is supplied with high pressure liquid, preferably water, through a supply pipe 12 and delivers a plurality of liquid streams, or jets, 14 in a curtain-like array onto a layer of fibrous material 16 which passes beneath the curtain of liquid streams 14 while supported on a conveyer 18, which typically is a rotating hollow drum.

Figure 2:
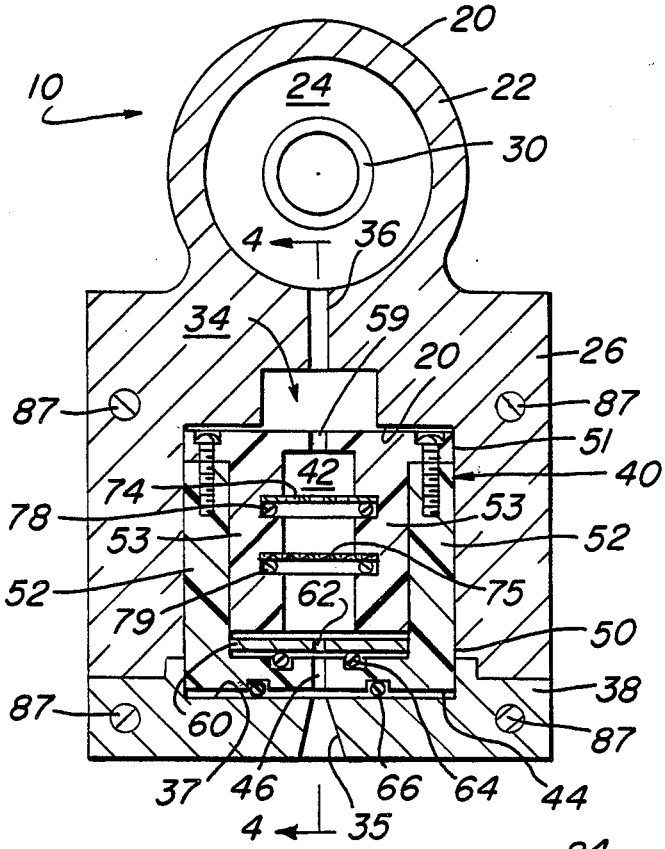
FIG. 2 is a section taken on line 2—2 of FIG. 1.
Figure 5:
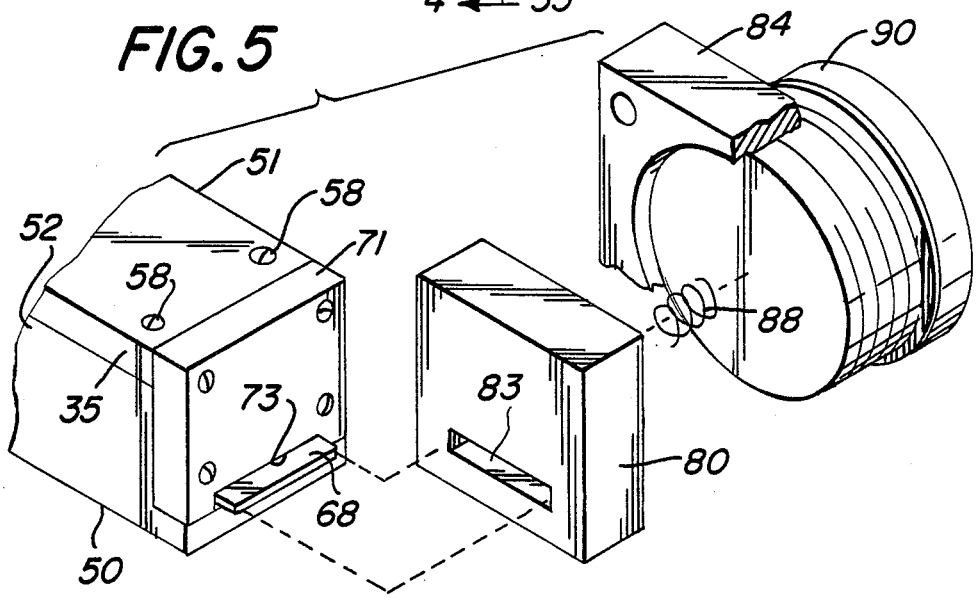
FIG. 5 is a fragmentary view of a detail showing the arrangement for access to the end of the cartridge.

The apparatus 10 in accordance with the invention comprises a manifold having a body 20 having an upper portion 22 which defines an elongated internal manifold chamber 24 and a lower portion 26 which defines an elongated internal cartridge chamber 28. The liquid supply pipe 12 is connected to one end of manifold chamber 24 through an end wall 13 of the upper body portion 22. The other end wall 15 of upper body portion 22 has a flow fitting 30 connected therein to which a pressure gage 32 is connected by way of an elbow 31 as shown in FIG. 1. The pressure gage 32 is used to provide an indication of the liquid pressure in manifold chamber 24. The manifold body 20 is designed to contain liquid up to about 2000 psig. As shown in FIG. 1, the upper body portion 22 and the manifold chamber 24 have a circular cross-section. As best shown in FIG. 2, the cartridge chamber 28 has a rectangular cross-section.

The manifold is provided with flow distribution means providing flow communication between manifold chamber 24 and an upper portion of cartridge chamber 28. Such means comprises an elongated distribution chamber 34 located above the top portion of the cartridge chamber 28, and a plurality of flow ports 36 spaced apart along the length of the distribution chamber 34 and arranged to provide flow communication between manifold chamber 24 and the distribution chamber 34. The flow ports 36 are provided by a plurality of drilled holes which extend between chambers 24 and 34. The size and spacing of the drilled holes forming the flow ports 36 are selected such that the nonuniformity of liquid distribution is less than ten percent over the length of the manifold body. By this arrangement, the liquid flowing from the manifold chamber 24 is discharged into distribution chamber 34 in a manner to provide some smoothing of liquid flow before entry into a cartridge 40 contained in chamber 28 and constructed to provide the curtain of water streams 14 as will be described hereafter.

The bottom wall of the rectangular cartridge chamber 28 is provided by a retaining plate 38 which is secured onto the lower end of the lower body portion 26 by means of suitable bolts. The surface 37 of the retaining plate 38 facing the cartridge chamber 28 is accurately machined to provide a smooth surface for fluid sealing purposes. The retaining plate 38 serves to retain the cartridge 40 within the chamber 28, cartridge 40 being inserted into the cartridge chamber 28 through a side access opening as will be described in detail hereafter. The retaining plate 38 provides a bottom wall portion of the manifold body 20 and has an elongated slot 35 therein providing communication between the lower portion of cartridge chamber 28 and the exterior of the manifold body 20. Slot 35 diverges in the direction of flow and is of a size and length to permit clear passage of the curtain of water streams 14 while ensuring sufficient support of cartridge 40 by retaining plate 38.

Cartridge 40 is comprised of an elongated body defining an elongated internal cartridge chamber 42 and providing a bottom wall 44 facing the retaining plate 38 and having an elongated slot 46 therein aligned with slot 35 in the retaining plate 38. The cartridge 40 fits into the chamber 28 with sufficient clearance so that it can be manually slid into and out of the operative position shown in the Drawings through the access opening in lower body portion 26 as will be described hereafter.

Figure 3:
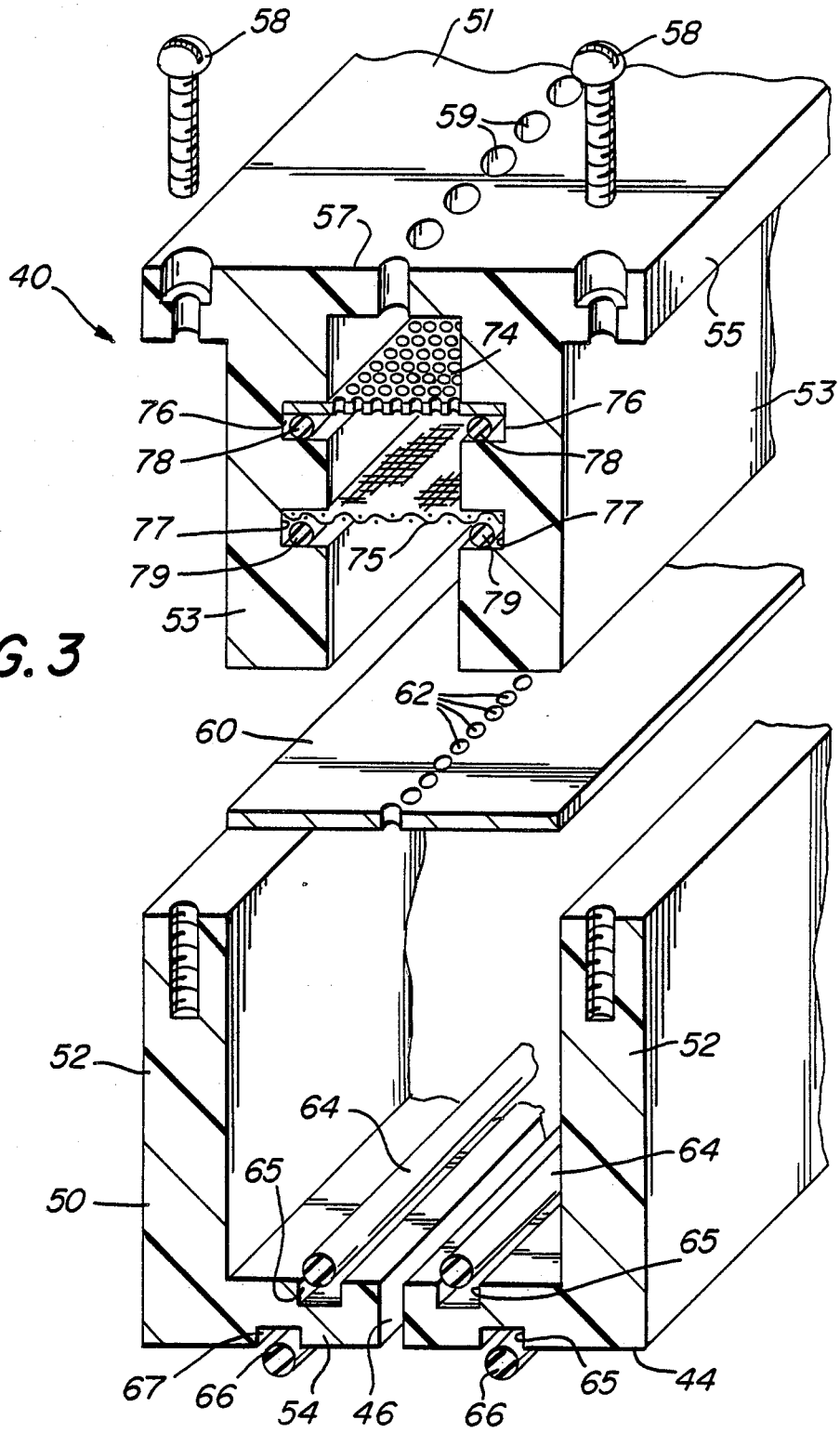
FIG. 3 is an exploded view showing the cartridge construction.

As best shown in FIG. 3, the body of cartridge 40 comprises a generally U-shaped bottom member 50, an inverted U-shaped top member 51 and a pair of end caps 70 and 71 secured to the ends of members 50 and 51 by mounting screws. Top member 51 has downwardly extending legs 53 received within upwardly extending legs 52 of bottom member 50. Top member 51 also has laterally extending flanges 55 which mate with the upper end of the legs 52 of bottom member 50 for use in securing the two members 50 and 51 together by means of a plurality of bolts 58 as shown in FIG. 3. The base 57 of top member 51 defines a top wall portion spaced apart from a bottom wall portion provided by the base 54 bottom member 50. The base 57 of member 51 has a plurality of flow ports 59 therein arranged in a row and providing flow communication between the upper portion of the cartridge 40 and the internal cartridge chamber 42 which is defined by the inwardly facing surfaces of bases 54 and 57 and legs 53.

A nozzle strip 60 is adapted to be positioned at the lower end of cartridge chamber 42 adjacent base 54 providing the bottom wall of the cartridge 40. Nozzle strip 60 is supported between the upper surface of the base 54 of bottom member 50 and the lower ends of the legs 53 of top member 51 as is apparent from a consideration of the Drawings. Nozzle strip 60 has a plurality of orifices 62 therein spaced apart along the length thereof and arranged in a row to be aligned with the cartridge slot 46 as is shown in the Drawings. The orifices 62 are constructed and arranged so as to provide concentrated jets of liquid and to discharge them in the curtain-like array of water streams 14 as shown in FIG. 1.

Cartridge 40 comprises means to provide a seal between the downstream surface of nozzle strip 60 and the adjacent top surface of base 54 forming the bottom wall portion of the cartridge 40. This sealing means comprises an elastomeric O-ring type of seal 64 which is arranged to be received in a recess 65 in base 54. Seal 64 and recess 65 have a rectangular configuration so as to enclose slot 46, as is apparent from a consideration of the Drawings.

There is provided a second sealing means which provides a seal between the bottom wall 44 of the cartridge 40 and the adjacent supporting surface 37 of the retaining plate 38. This sealing means comprises an elastomeric O-ring type of seal 66 which is arranged to be received in a recess 67 in base 54. Seal 66 and recess 67 have a rectangular configuration so as to enclose both the cartridge slot 46 and the manifold body slot 35 as is apparent from a consideration of the Drawings.

It will be apparent that the liquid pressure within the manifold body 20 during operation produces the force required to seat the nozzle strip 60 on the seal 64 and also causes the bottom wall 44 of cartridge 40 to be seated against the seal 66 which is seated against the surface 37 of retaining plate 38.

The parts are constructed and arranged to provide clearance within the cartridge 40 such that the nozzle strip 60 fits loosely therein, the legs 53 of the top member 51 providing a measure of restraint to the nozzle strip 60 which would be useful in an application where the apparatus is oriented to jet liquid at an angle with respect to the vertical of greater than ninety degrees, in which case when the pressurized liquid is supplied to the nozzle strip 60, it will seat properly against the seal 64 as described above.

The apparatus 10 is provided with screen means positioned in the cartridge internal chamber 42 to extend thereacross. The arrangement is such that the screen means extends transversely across the direction of flow of the liquid from flow ports 36 to orifices 62 for a purpose to be described hereafter. More specifically, the screen means comprises a pair of screen members 74 and 75 located in spaced apart relation within the cartridge chamber 42. The upper screen member 74 has an upstream surface facing the top wall portion of the cartridge 40 and the lower screen member 75 has its downstream surface facing the nozzle strip 60. The upper screen member 74 preferably comprises an electroformed or photochemically etched perforated plate of approximately 18–25 percent open area. The lower screen member 75 preferably comprises a woven wire mesh of approximately 150–350 wires per inch and a 35–50 percent open area.

The outer edges of screen members 74 and 75 are received in recessed portions in the parts of the cartridge body defining chamber 42 and cooperate with sealing means for providing a seal between the recessed portions receiving each of the screen members 74 and 75 and the cartridge body. The recessed portions 76 and 77 in the cartridge 40 that receive the outer edge portions of the screen members 74 and 75, respectively, are formed by grooves in the legs 53 of top member 51 and in the end pieces 70 and 71, which grooves are aligned to in effect provide a rectangular border extending around and overlapping the outer edge portions of the screen members 74 and 75, as is apparent from a consideration of the Drawings. The screen members 74 and 75 are held in place in recessed portions 76 and 77, respectively, by means of elastomeric O-ring type seals 78 and 79, respectively, which are fit in the corresponding grooves with a press fit. The O-ring type of seals 78 and 79 provide a seal at the borders of the screen members 74 and 75 so as to prevent liquid from bypassing the screen members 74 and 75 and possibly causing a disturbance in the uniform perpendicular entry of the flow of liquid into the orifices 62 of nozzle strip 60.

The manifold body 20 is provided with an access opening for providing access to one end of the body of cartridge 40. To this end, a cover plate 80 is adapted to be removably received in a rectangular access opening 82 formed in the lower body portion 26 adjacent one end of cartridge chamber 28, which end is closed by an end cap 84. The other end of cartridge chamber 28 is closed by an end cap 85. End caps 84 and 85 are rectangular and each are secured to the lower portion 26 of manifold body 20 by four mounting bolts 86 and 87, respectively. The lower pair of each of the bolts threadedly engage retaining plate 38 for securing the same onto the lower end of lower body portion 26 (See FIGS. 1 and 2). Means are provided for holding the cover plate 80 in position and to retain the cartridge 40 within chamber 28 in the manifold body 20. To this end, the cartridge end cap 71, which is located adjacent the access opening 82, is provided with a clearance slot 73 formed therein providing communication between the access opening 82 and the cartridge chamber 42 at a location aligned with the position of the nozzle strip 60. Also, the cover plate 80 has a relief slot 83 formed therein located to be aligned with slot 73 and the position of the nozzle strip 60. Slots 73 and 83 are of a size to receive the nozzle strip 60 and the nozzle strip 60 is of such a length that an end portion 68 thereof extends through slot 73 and outwardly from the end cap 71 to be received in slot 83. The removal of cover plate 80 makes end portion 68 accessible for removal of the nozzle strip 60 from the cartridge 40 while the cartridge 40 is in position within chamber 28 of the manifold body 20. In the position of the parts shown in FIG. 4, slot 83 provides relief for the outwardly extending end portion 68 of the nozzle strip 60. The cover plate 80 has a spring 88 received in a bore 89 in its outer surface. Spring 88 is positioned in compression between the cover plate 80 and an access cover 90 which is threadedly secured in a threaded bore 91 extending through end cap 84, this arrangement being best shown in FIG. 4. Access cover 90 is sealed to end cap 84 by an elastomeric O-ring seal 92. Bore 91 is larger than cartridge 40 and cartridge chamber 28 so that removal of access cover 90 allows removal of cover plate 80 and cartridge 40 therethrough.

Figure 4:
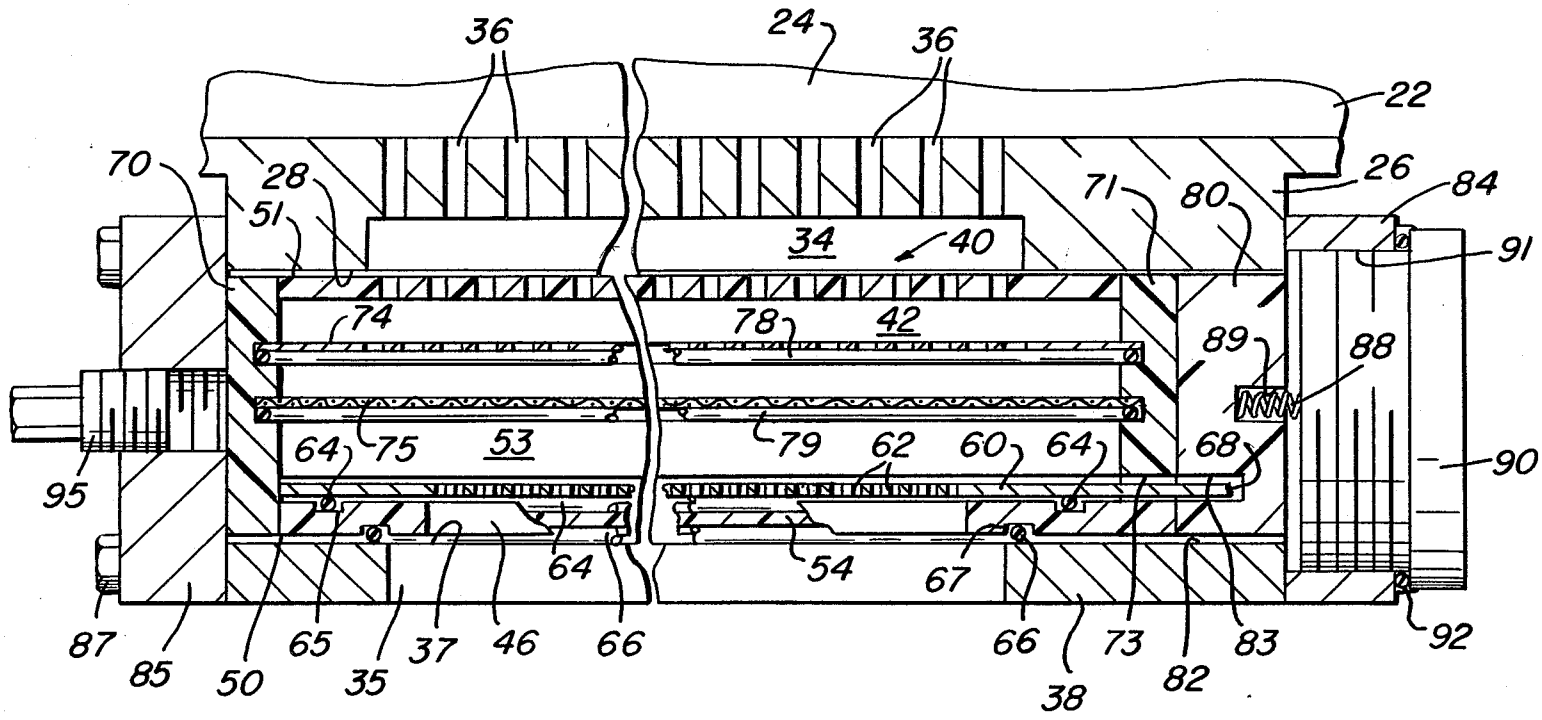
FIG. 4 is a sectional view taken on line 4—4 of FIG. 2.

In the assembly of the apparatus 10, the cartridge 40 is placed into the cartridge chamber 28 by being slid through the access opening 82 while cover plate 80 and access cover 90 are removed. After cartridge 40 is completely inserted, the cover plate 80 is slid into position within access opening 82, as best shown in FIG. 4, and the access cover 90 is threaded into the threaded opening 91 in end cap 84 while the spring 88 is contained in the recess 89 in the cover plate 80. By this arrangement, the spring 88 loads the access cover 90 and urges the cover plate 80 against the end cap 71 and the cartridge body against end cap 85. When pressurized liquid is applied to the manifold chamber 24 the differential pressure between the internals of the cartridge 40 and the cartridge chamber 28 creates a force on the cover plate 80 that holds it tightly against the end cap 71 thereby preventing liquid from bypassing the screen members 74 and 75.

The above-described arrangement permits the quick and easy changing of a nozzle strip 60 contained in a cartridge 40 as has been demonstrated in tests. When it is required to clean a nozzle strip 60 due to contamination or the like, one simply has to remove the access cover 90, withdraw the cover plate 80 and grasp the protruding end portion 68 of the nozzle strip 60, as by a special tool (not shown), and withdraw the nozzle strip 60 from the cartridge 40. If one should desire to remove the cartridge 40 for replacing and cleaning of the screen members 74 and 75, for example, then the plug 95 in end cap 85 must be additionally removed and a special rod inserted to push the cartridge 40 from the body manifold 20. Plug 95 is aligned with the longitudinal axis of cartridge 40. This novel arrangement can save considerable downtime and provide savings in man hours when required to remove nozzle strips from the apparatus for cleaning. Moreover, the unique liquid distribution and screen devices additionally provide a heretofore unexcelled jet quality resulting directly in improved product quality and customer satisfaction.

In a preferred embodiment of the invention, the manifold body 20 is constructed of type 304 L stainless steel. Also, the cartridge 40 can be of a type of material suitable for operation with the liquid medium to be used and sufficiently close in electro-chemical potential to stainless steel to eliminate electrolytic reactions. It has been found that plastics with a high rigidity and low water absorbtion rate, such as "Delrin" ®, are ideal for the application. The nozzle strip 60 is preferably made of a stainless steel suitable for the application.

In accordance with the preferred embodiment of the invention, the liquid as it passes through the cartridge 40 progresses successively from a lower open area to a higher open area and more concentrated jets to produce smooth flow patterns whereby the liquid approaches the nozzle strip orifices 62 in an essentially uniform, smooth flow while truly perpendicular to the nozzle strip 60. This is apparent from a consideration of the construction and arrangement of the single row of drilled holes 59, the large number of holes in the perforated plate 74 and the openings throughout the surface of wire mesh screen 75.

In the use of the apparatus 10 for delivering high velocity liquid jets 14 into the fibrous web 16, high pressure liquid is supplied through supply pipe 12 and passes into manifold chamber 24. From manifold chamber 24 the liquid passes through a first flow distribution means comprising the row of flow ports 36 which provide some smoothing of the flow of liquid as it is delivered to the distribution chamber 34. From distribution chamber 34 the liquid passes through a secondary flow distribution means comprising the row of flow ports 59 providing flow communication between the upper portion of cartridge 40 and the internal cartridge chamber 42. The secondary distribution means also comprises the two screen members 74 and 75 through which the liquid flows successively from the top to the bottom portion of cartridge chamber 42. The natural deflection of the screen members 74 and 75 under the differential pressure applied by the liquid flowing downwardly through cartridge chamber 42 serves to retain both screen members 74 and 75 in place and the O-ring seals 78 and 79 associated therewith in place within the recessed portions 76 and 77. A feature of the construction is the sealing of the screen members 74 and 75 throughout their outer edges with the end pieces 70 and 71 and the side legs 53 of the cartridge member 51 in a manner to prevent any liquid flow from bypassing the screen members 74 and 75. The flow of the liquid through the screen members 74 and 75 further smooths the flow of the liquid and improves the distribution of the liquid medium as it flows to the orifices 62 of nozzle strip 60. The liquid is discharged from cartridge chamber 42 through the orifices 62 in nozzle strip 60 and flows as high velocity liquid jets, i.e., liquid streams 14, in a curtain-like array through slots 46 and 35 onto the layer of fibrous material 16 which is supported on the conveyer 18. The arrangement is such that the screen members 74 and 75 deliver the liquid streams in a manner to allow the liquid streams to enter perpendicularly into the nozzle strip orifices 62 which improves the quality of the jets 14 passing onto the fibrous web 16.

It will be apparent that various changes may be made in the construction and arrangement of parts without departing from the scope of the invention as defined by the following claims. For example, the design may consist of a rectangular body portion 22 with a circular manifold chamber 24.

What is claimed is:

1. An apparatus for delivering high velocity liquid jets into a fibrous web for jet entanglement purposes comprising:

a manifold having a body defining an elongated internal manifold chamber and an elongated internal cartridge chamber, and flow distribution means providing flow communication between said manifold chamber and an upper portion of said cartridge chamber, said manifold body having a bottom wall portion having an elongated slot therein providing communication between a lower portion of said cartridge chamber and the exterior of said manifold body, an elongated cartridge adapted to be received in said cartridge chamber of said manifold body in a position to be supported by said bottom wall portion thereof and to overlie said slot therein, said cartridge having a body defining an elongated internal chamber and a bottom wall portion adjacent said bottom wall portion of said manifold body and having an elongated slot therein aligned with said slot in said bottom wall portion of said manifold body, said cartridge having a top wall portion spaced apart above said bottom wall portion thereof and having a plurality of flow ports therein arranged to receive flow from said flow distribution means and deliver said flow into said cartridge chamber, said cartridge internal chamber being enclosed within said cartridge and located between said top wall and bottom wall portions of said cartridge, a nozzle strip adapted to be positioned adjacent said bottom wall of said cartridge and having a plurality of orifices therein aligned with said cartridge slot, and screen means positioned within said cartridge chamber to extend thereacross at at least one location spaced apart between said top wall portion and said bottom wall portion of said cartridge, said manifold body, said cartridge, said nozzle strip and said screen means being constructed and arranged so that high pressure liquid delivered to said manifold chamber flows through said flow distribution means to the upper portion of said cartridge from which the liquid flows sequentially through said flow ports in said top wall portion of said cartridge into said cartridge chamber, through said screen means, and through said nozzle strip orifices, the liquid being discharged from said nozzle strip orifices in a plurality of high velocity jets passing through said cartridge slot and said manifold body slot, said cartridge having an end cap having a clearance slot, and said nozzle strip being of a length such that an end portion thereof extends outwardly from said end cap thorough said clearance slot so that it is accessible for removal of the nozzle strip from said cartridge without the disassembly of said cartridge.

2. An apparatus according to claim 1 wherein said flow distribution means comprises a distribution chamber located above said top wall portion of said cartridge and extending along said flow ports in said top wall portion of said cartridge, and a plurality of distribution flow ports spaced apart along the length of said manifold chamber to provide flow communication between said manifold chamber and said distribution chamber.

3. An apparatus according to claim 1 wherein said screen means comprises a pair of screen members located in spaced apart relation within said cartridge chamber, one of said screen members having its upstream surface facing said top wall portion of said cartridge and the other of said screen members having its downstream surface facing said nozzle strip.

4. An apparatus according to claim 3 wherein said one screen member comprises a perforated plate, and said other screen member comprises a woven wire mesh screen.

5. An apparatus according to claim 3 wherein each of said screen members is received in a recessed portion in the chamber defining portion of said cartridge body and including sealing means for providing a seal between said recessed portions of each of said screen members and said cartridge body.

6. An apparatus according to claim 3 wherein the portion of said cartridge chamber between the downstream surface of said one screen member and the upstream surface of said other screen member is devoid of any structure blocking the liquid flow between the two screen members so that said one screen member delivers a uniform flow of liquid to said other screen member.

7. An apparatus according to claim 4 wherein said perforated plate is photo-etched and has approximately 18 to 25 percent open area, and said woven wire mesh screen consists of a 150 to 300 woven wire mesh of between 35 and 50 percent open area.

8. An apparatus according to claim 5 wherein each of said screen members is mounted individually of the other screen member whereby said screen members are separately replaceable members.

9. An apparatus according to claim 1 including a first sealing means providing a seal between the downstream surface of said nozzle strip and the top surface of said bottom wall portion of said cartridge, said first sealing means enclosing said slot in said bottom wall portion of said cartridge.

10. An apparatus according to claim 9 including a second sealing means providing a seal between the bottom surface of said bottom wall portion of said cartridge and the adjacent supporting surface of said bottom wall portion of said manifold body, said second sealing means enclosing both said cartridge slot and said manifold body slot.

11. An apparatus according to claim 1 including a second end cap at the other end of said cartridge for enclosing the same, said screen means being supported at least partially on said end caps and including sealing means for providing a seal between said screen means and said end caps.

12. An apparatus for delivering high velocity liquid jets into a fibrous web for jet entanglement purposes comprising:

a manifold having a body defining an elongated internal manifold chamber and an elongated internal cartridge chamber, and flow distribution means providing flow communication between said manifold chamber and an upper portion of said cartridge chamber, said manifold body having a bottom wall portion having an elongated slot therein providing communication between a lower portion of said cartridge chamber and the exterior of said manifold body, an elongated cartridge adapted to be received in said cartridge chamber of said manifold body in a position to be supported by said bottom wall portion thereof and to overlie said slot therein, said cartridge having a body defining an elongated internal chamber and a bottom wall portion adjacent said bottom wall portion of said manifold body and having an elongated slot therein aligned with said slot in said bottom wall portion of said manifold body, said cartridge having a top wall portion spaced apart above said bottom wall portion thereof and having a plurality of flow ports therein arranged to receive flow from said flow distribution means and deliver said flow into said cartridge chamber, a nozzle strip adapted to be positioned adjacent said bottom wall of said cartridge and having a plurality of orifices therein aligned with said cartridge slot, said manifold body being provided with an access opening providing access to one end of said cartridge body, a cover plate adapted to be removably received in said access opening, and means for holding said cover plate in position to retain said cartridge within said cartridge chamber, said cartridge having an end cap located adjacent said access opening and having a clearance slot formed therein providing communication between said access opening and said cartridge chamber at a location aligned with the position of said nozzle strip, said nozzle strip being of a length such that an end portion thereof extends outwardly from said end cap so that it is accessable for the removal of said nozzle strip from said cartridge while said cartridge remains within said manifold body.

13. An apparatus according to claim 12 wherein said means for holding said cover plate in position to retain said cartridge within said cartridge chamber includes a spring for urging said cover plate into intimate contact with a mating surface on said end cap.

14. An apparatus for delivering high velocity liquid jets into a fibrous web for jet entanglement purposes comprising:

a manifold having a body defining an elongated internal manifold chamber and an elongated internal cartridge chamber, and flow distribution means providing flow communication between said manifold chamber and an upper portion of said cartridge chamber, said manifold body having a bottom wall portion having an elongated slot therein providing communication between a lower portion of said cartridge chamber and the exterior of said manifold body, an elongated cartridge adapted to be received in said cartridge chamber of said manifold body in a position to be supported by said bottom wall portion thereof and to overlie said slot therein, said cartridge having a body defining an elongated internal chamber and a bottom wall portion adjacent said bottom wall portion of said manifold body and having an elongated slot therein aligned with said slot in said bottom wall portion of said manifold body, said cartridge having a top wall portion spaced apart above said bottom wall portion thereof and having a plurality of flow ports therein arranged to receive flow from said flow distribution means and deliver said flow into said cartridge chamber, said cartridge internal chamber being enclosed within said cartridge and located between said top wall and bottom wall portions of said cartridge, a nozzle strip adapted to be positioned adjacent said bottom wall of said cartridge and having a plurality of orifices therein aligned with said cartridge slot, and screen means positioned within said cartridge chamber to extend thereacross at at least one location spaced apart between said top wall portion and said bottom wall portion of said cartridge, said manifold body, said cartridge, said nozzle strip and said screen means being constructed and arranged so that high pressure liquid delivered to said manifold chamber flows through said flow distribution means to the upper portion of said cartridge from which the liquid flows sequentially through said flow ports in said top wall portion of said cartridge into said cartridge chamber, through said screen means, and through said nozzle strip orifices, the liquid being discharged from said nozzle strip orifices in a plurality of high velocity jets passing through said cartridge slot and said manifold body slot, said manifold body being provided with an access opening providing access to one end of said cartridge body, and including a cover plate adapted to be removably received in said access opening and means for holding said cover plate in position to retain said cartridge within said cartridge chamber, said cartridge having an end cap located adjacent said access opening and having a clearance slot formed therein providing communication between said access opening and said cartridge chamber at a location aligned with the position of said nozzle strip, said nozzle strip being of a length such that an end portion thereof extends outwardly from said end cap so that it is accessible for the removal of said nozzle strip from said cartridge while said cartridge remains within said manifold body.

* * * * *